US006644656B2

(12) United States Patent
Muranaka

(10) Patent No.: US 6,644,656 B2
(45) Date of Patent: Nov. 11, 2003

(54) PAPER FEEDER

(75) Inventor: Yoshiharu Muranaka, Osaka (JP)

(73) Assignee: Funai Electric Co., Ltd. (JP)

( * ) Notice: Subject to any disclaimer, the term of this patent is extended or adjusted under 35 U.S.C. 154(b) by 150 days.

(21) Appl. No.: 09/962,048

(22) Filed: Sep. 25, 2001

(65) Prior Publication Data

US 2002/0074719 A1 Jun. 20, 2002

Related U.S. Application Data

(63) Continuation of application No. 09/420,647, filed on Oct. 19, 1999.

(30) Foreign Application Priority Data

Oct. 20, 1998 (JP) ..... 10-8257

(51) Int. Cl.[7] ..... B65H 5/00

(52) U.S. Cl. ..... 271/225; 271/184; 271/902; 347/104; 399/392

(58) Field of Search ..... 271/225, 184, 271/902, 265.01, 258.01; 347/104, 153, 215–219, 264; 399/16–23, 168, 176, 357, 373, 388, 392, 397, 401, 405; 101/230–232, 247

(56) References Cited

U.S. PATENT DOCUMENTS 3,704,360 A * 11/1972 McFadden ..... 235/480
4,695,171 A * 9/1987 Sapitowicz ..... 400/70
4,786,920 A * 11/1988 Igarashi ..... 346/134
4,818,126 A * 4/1989 Brooks et al. ..... 400/120.16
4,925,325 A * 5/1990 Niikawa ..... 400/582
5,035,413 A * 7/1991 Yamada et al. ..... 271/9.01
5,223,905 A * 6/1993 Yamada et al. ..... 399/370
5,630,581 A * 5/1997 Rodesch ..... 271/23
5,648,812 A * 7/1997 Igarashi ..... 347/262
6,185,478 B1 * 2/2001 Koakutsu et al. ..... 700/213

FOREIGN PATENT DOCUMENTS

| | | |
|---|---|---|
| JP | Sho.58-166454 | 10/1983 |
| JP | 87276 | 4/1991 |
| JP | 5-24709 | 2/1993 |
| JP | 112040 | 5/1993 |
| JP | Hei.67833 | 3/2000 |

* cited by examiner

*Primary Examiner*—Donald P. Walsh
*Assistant Examiner*—Jeffrey A. Shapiro
(74) *Attorney, Agent, or Firm*—Lackenbach Siegel LLP

(57) ABSTRACT

A paper feeder including a platen roller for feeding paper sheet supplied from a manual paper supply opening to a printing section and conveying the same after printing again to the manual paper supply opening so as to be discharged. In the paper feeder, the length of the paper sheet supplied from the manual paper supply opening is the same as the distance between a paper sensor disposed at the manual paper supply opening and the paper catching position of the platen roller, and the platen roller is inversely rotated by the length when the power source is switched on, and therefore a paper sheet remaining in a conveyance path can be discharged certainly to the manual paper supply opening.

5 Claims, 4 Drawing Sheets

PAPER FEEDER

This application is a continuation of Ser. No. 09/420,647 filed on Oct. 19, 1999.

BACKGROUND OF THE INVENTION

1. Field of the Invention

The present invention relates to a paper feeder, wherein a paper sheet manually supplied from a paper supply opening is fed to a printing section by a roller, such as a platen roller, and is discharged also by the roller.

2. Description of the Related Art

In conventional paper feeders, in addition to a sensor for detecting whether a paper sheet is set at the paper supply opening, one or more sensors are provided in a paper conveyance path for detecting the state of the paper sheet remaining in the device or jamming of the paper sheet. For example, a device disclosed in Japanese Patent Unexamined Publication No. Hei. 2-141270 comprises a paper insertion set detecting sensor and a paper empty sensor for detecting the absence of a paper sheet provided in the paper supply opening and the paper conveyance path. Further, another device disclosed in Japanese Patent Unexamined Publication No. Hei. 8-290868 comprises a paper discharge sensor for detecting the state of a paper sheet remaining in the conveyance path.

Since a paper sheet may be left in the device or may cause jamming by an error during operation in the conventional paper feeders, the sensors are provided in the conveyance path for detecting these problems. That is, absence of a paper sheet remaining in the device can be confirmed at the time of supplementing new paper sheets.

However, in the conventional paper feeders, a sensor specially for detecting the state of a paper sheet remaining in the device is required. Therefore, in the case a paper sheet set at the paper supply opening needs to be detected, at least two sensors including a paper sensor and a sensor for detecting a remaining paper sheet are required so as to enable the cost reduction of the device.

SUMMARY OF THE INVENTION

Accordingly, an object of the invention is to provide a paper feeder capable of removing a paper sheet remaining in the device without the need of a sensor specially for detecting the remaining state of the paper sheet.

In order to achieve the above object, according to the invention, there is provided a paper feeder comprising: a roller for feeding a paper sheet supplied from a manual paper supply opening to a printing section and discharging the paper sheet after printing to a paper discharge opening; and controlling means for rotating the roller at a predetermined time before paper supply by a predetermined length toward the paper discharge opening.

The paper feeder has a configuration wherein a paper sheet supplied from the manual paper supply opening is fed to the printing section by the roller such as a platen roller, and is further discharged after printing to the paper discharge opening by the same roller. That is, a paper sheet is supplied and discharged only with one roller. Therefore, by rotating the roller by a certain length toward the paper discharge opening direction at a certain time such as when the power source is switched on, a paper sheet remaining in the device can surely be discharged to the paper discharge opening. For example, in the case the paper supply opening and the paper discharge opening are the same, the paper sheet supplied from the paper supply opening returns in the opposite direction after printing in the printing section. In this case, by inversely rotating the paper feed roller in the paper supply opening (paper discharge opening) direction by a certain length at a specific time such as when the power source is switched on, even in the case a paper sheet remains in the paper feeder, the paper sheet can be returned to the paper supply opening certainly. When new paper sheets are supplemented, the paper sheets can be set at the paper supply opening after removing the returned paper sheet manually.

DETAILED DESCRIPTION OF THE PREFERRED EMBODIMENT

Figure 1:
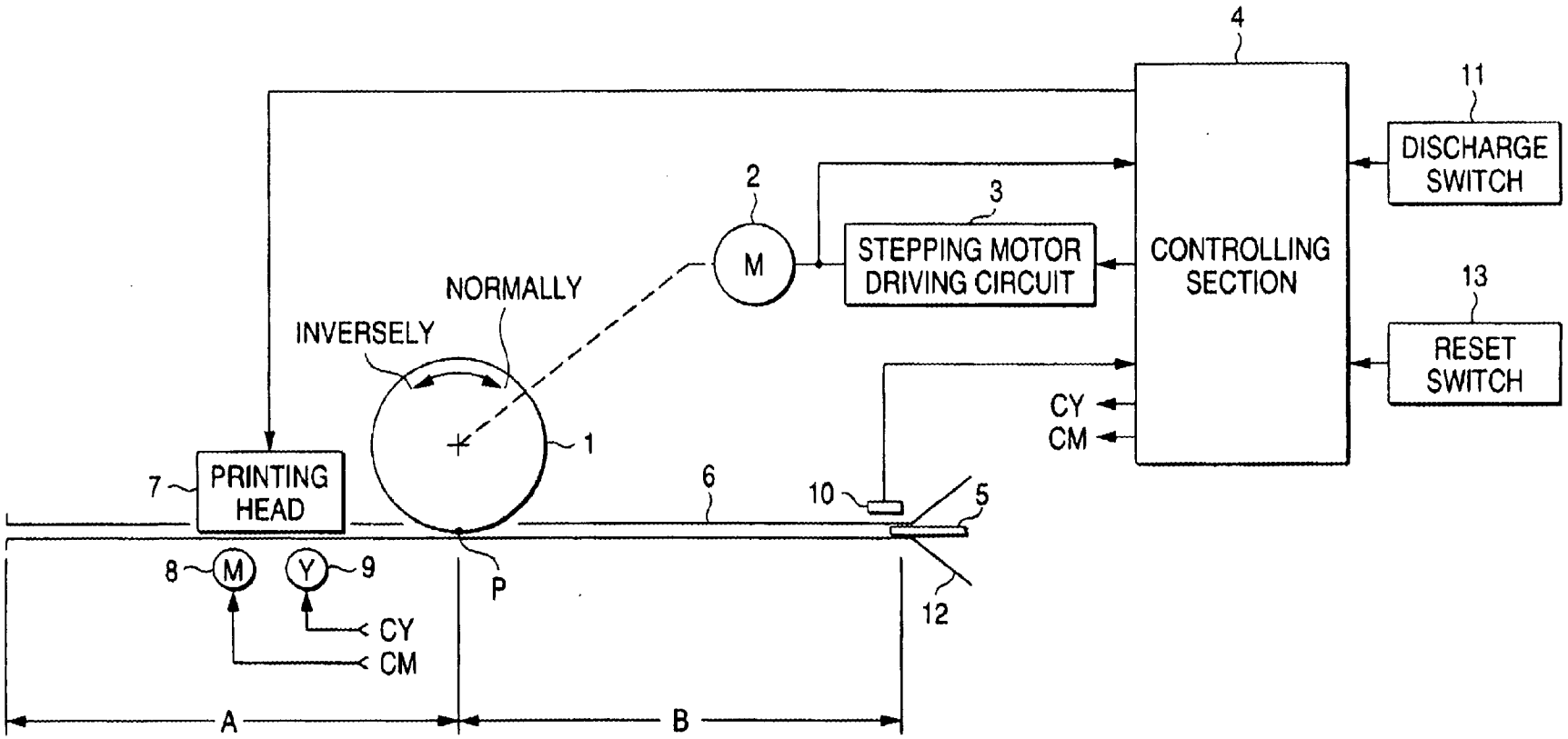
FIG. 1 is a schematic diagram showing the configuration of a video printer according to an embodiment of the invention.

FIG. 1 is a diagram showing the configuration of the principal part of a video printer according to an embodiment of the invention.

Figure 2:
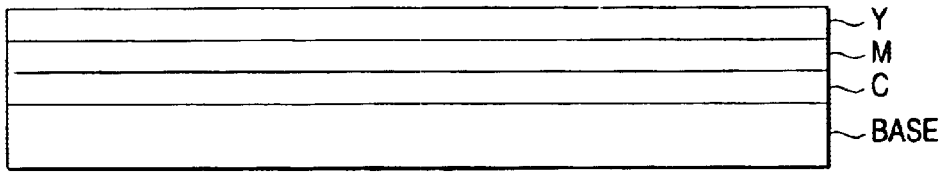
FIG. 2 is a diagram showing the configuration of a TA paper sheet.

As shown in FIG. 2, a TA photosensitive paper sheet, with layers having pigments of Y, M and C filled therein laminated on a base comprising a resin such as polyester such that the paper sheet can be colored according to reaction between developers provided in the layers and the pigments by heating, is used in the video printer.

In FIG. 1, a platen roller 1, with the rotary shaft interlocked with a stepping motor 2, can rotate in both normal direction and inverse direction. A stepping motor driving circuit 3 transmits a pulse corresponding to the moving amount to the stepping motor 2 based on a controlling signal from a controlling section 4. The rotation amount of the stepping motor 2 is fed back to the controlling section 4. The rotation amount of the stepping motor 2, that is, the moving amount of a paper sheet 5 fed by the platen roller 1 is monitored by the controlling section 4. A conveyance path 6 has a length double as much as the length of the paper sheet 5 to be used, with the platen roller 1 provided in the middle position thereof. The paper sheet to be used here has a postcard size, and thus the lengths A and B in the conveyance path 6 are postcard size lengths respectively. A printing head 7 for printing the paper sheet 5 is disposed behind the platen roller 1 above lamps 8 and 9 disposed facing with the head 7. The lamps 8 and 9 each selectively activates the color layer in the paper sheet so as to develop the color by heating by the printing head 7. Further, a paper sensor 10 for optically detecting presence or absence of a paper sheet is provided at a manual paper supply opening 12 of the paper sheet 5 so as to detect the tip of the paper sheet 5 supplied and the rear end of the paper sheet 5 passing the position. Moreover, the controlling section 4 is connected with a discharge switch 11 for the paper sheet 5 and a reset switch 13. Furthermore, a heating signal to the printing head 7 and a lighting signal to the lamps 8 and 9 are outputted respectively from the controlling section 4.

With the above configuration, when a paper sheet 5 is supplied manually into the manual paper supply opening 12, the paper sensor 10 detects the tip of the paper sheet 5 so that the stepping motor 2 is driven for normally rotating the platen roller 1. When the tip of the paper sheet 5 introduced by a user manually reaches at the paper catching position P of the platen roller 1, thereafter the paper sheet 5 is fed according to the drive of the platen roller 1 in the normal rotation direction.

Ordinarily, when the paper sensor 10 detects the passage of the rear end of the paper sheet 5 (sensor off) after introducing the paper sheet 5 in the normal rotation direction, then the platen roller 1 is rotated inversely so as to feed the paper sheet 5 in the paper supply opening direction. When the sensor 10 again detects the rear end of the paper sheet 5, the platen roller 1 is again rotated normally so as to feed the paper sheet 5 to the print starting position. Accordingly, when the paper sheet 5 is supplied, positioning of the platen roller 1 and the paper sheet 5 is ensured according to the reciprocal operation of the paper sheet 5. Thereafter, by the normal rotation of the platen roller 1, the paper sheet 5 is moved by a stepping amount set by the controlling section 4. During the movement, an image is printed on a certain position by the printing head 7. After executing the required printing operation, the paper sheet 5 is returned to the manual paper supply opening 12 according to the inverse rotation of the platen roller 1. At this time, since the lengths of A and B are set to be equal to the length of the paper sheet 5, when the paper sheet 5 has been sent to the direction of the manual paper supply opening 12, the rear end part of the paper sheet 5 is slightly outside the manual paper supply opening 12. The user can obtain the printed paper sheet 5 by grasping the rear end part of the paper sheet 5 and pulling it out.

Figure 3:
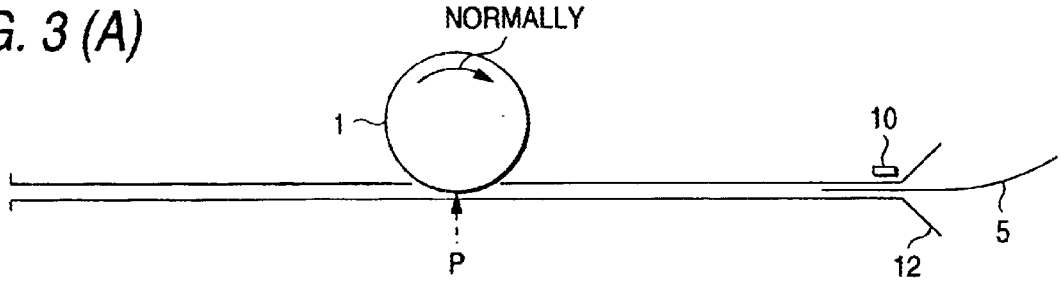
FIGS. 3(A) to 3(C) are diagrams for explaining the normal and inverse rotation control of a platen roller at the time of paper supply.
Figure 3:
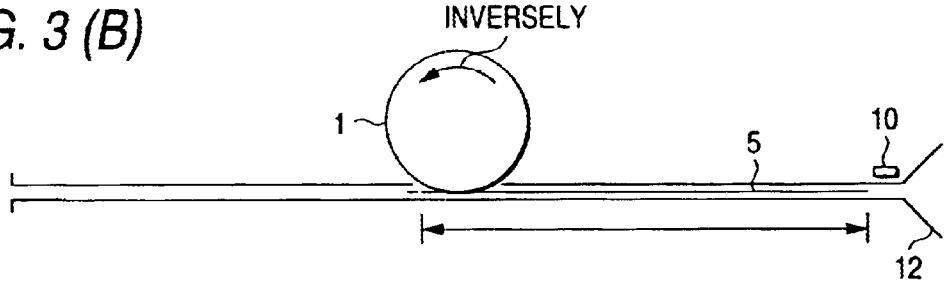
Figure 3:
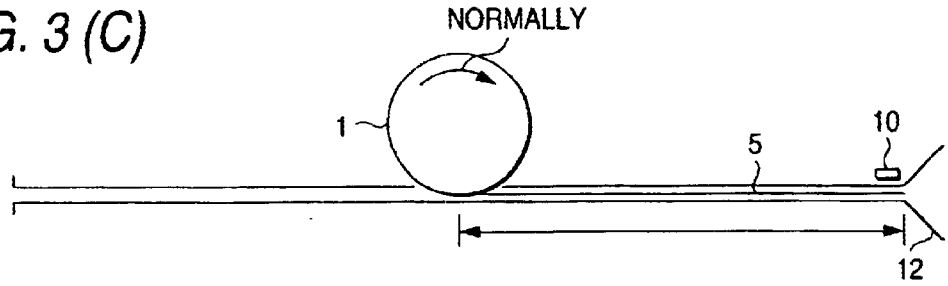

FIGS. 3(A) to 3(C) are diagrams for explaining the rotation control of the platen roller 1 at the time of inserting the paper sheet 5 to the manual paper supply opening 12 and positioning the same.

As shown in FIG. 3(A), when the paper sheet 5 is inserted into the manual paper supply opening 12, the paper sensor 10 detects the insertion so that the platen roller 1 is driven in the normal rotation direction. When the paper sheet 5 is introduced further so that the tip thereof reaches at the paper catching position P of the platen roller 1, thereafter the paper sheet 5 is further introduced by the driving force of the platen roller 1. Then, as shown in FIG. 3(B), the passage of the rear end of the paper sheet 5 is detected by the paper sensor 10. The platen roller 1 is driven in the inverse rotation direction at this timing. Since the paper sheet 5 is returned toward the manual paper supply opening 12, the sensor 10 detects the rear end of the paper sheet 5. At this time, as shown in FIG. 3(C), the platen roller 1 is again driven in the normal rotation direction so as to wait for a printing command when it reaches at a predetermined print starting position (for example, at a position of a predetermined number of steps from the normal rotation drive of the platen roller 1 after detecting the rear end of the paper sheet 5 by the sensor 10). According to the procedure of FIGS. 3(A) to 3(C), positioning of the platen roller 1 and the paper sheet 5 can be ensured, and thus the paper sheet 5 can be fed to the printing head section provided behind the roller 1 certainly by the normal rotation drive of the platen roller 1.

The operation of printing a paper sheet 5 is as described above. Further, when the power source is switched on, when the reset switch 13 is pressed, or when the discharge switch 11 is pressed, the platen roller 1 is controlled so as to inversely rotate for a constant time. That is, when the power source is switched on or either of the switches 11 and 13 is pressed, the platen roller 1 is rotated inversely by the length A or B shown in FIG. 1. This control is executed regardless of detection of the paper sheet 5 by the sensor 10. Accordingly, even if a paper sheet is remaining in anywhere in the conveyance path 6, the remaining paper sheet can be discharged from the manual paper supply opening 12 before a new paper sheet 5 is inserted into the manual paper supply opening 12.

Figure 4:
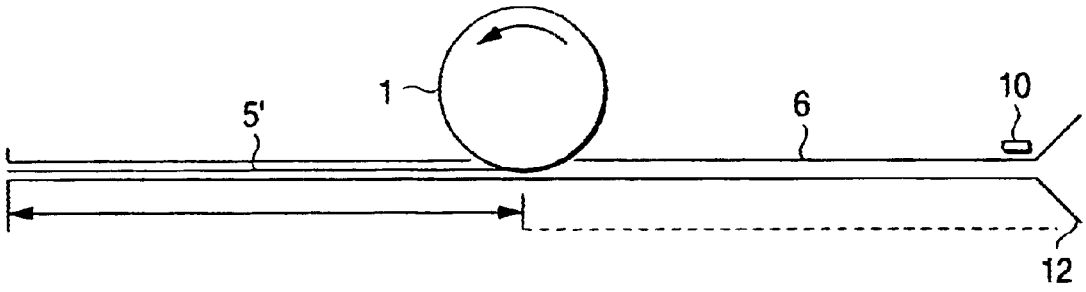
FIGS. 4(A) to 4(C) are diagrams for explaining how a paper sheet remaining in a conveyance path can be discharged certainly.
Figure 4:
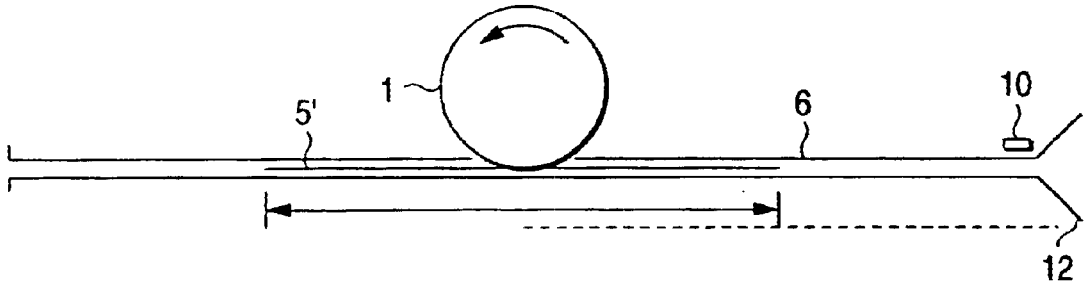
Figure 4:
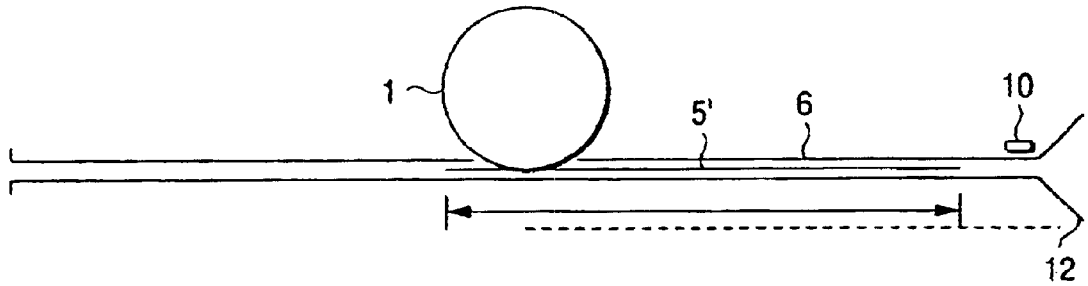

FIGS. 4(A) to 4(C) show examples of the position of a paper sheet remaining in the conveyance path 6. FIG. 4(A) shows the case when the paper sheet 5' is remaining at the innermost position. FIG. 4(B) shows the case at the substantially center position. FIG. 4(C) shows the case in the vicinity of the manual paper supply opening. Since the platen roller 1 is rotated inversely by the distance A or B, that is, the length from the paper catching position P of the platen roller 1 to the paper sensor 10 (equal to the length of the paper sheet 5) in either case, the remaining paper sheet 5' is fed to the manual paper supply opening 12 certainly. The position in the figure marked with the dotted line shows the state of the remaining paper sheet 5' fed to the manual paper supply opening 12. If the rear end of the remaining paper sheet 5' is outside the manual paper supply opening 12, the user can remove the remaining paper sheet 5' by grasping and pulling the rear end part thereof. Moreover, since the paper sensor 10 detects the remaining paper sheet 5' , return of the remaining paper sheet 5' to the manual paper supply opening 12 may be indicated by an indication lamp or the like according to the ouput of the paper sensor 10. Then, a new paper sheet 5 can be printed according to the procedure shown in FIGS. 3(A) to 3(C).

Figure 5:
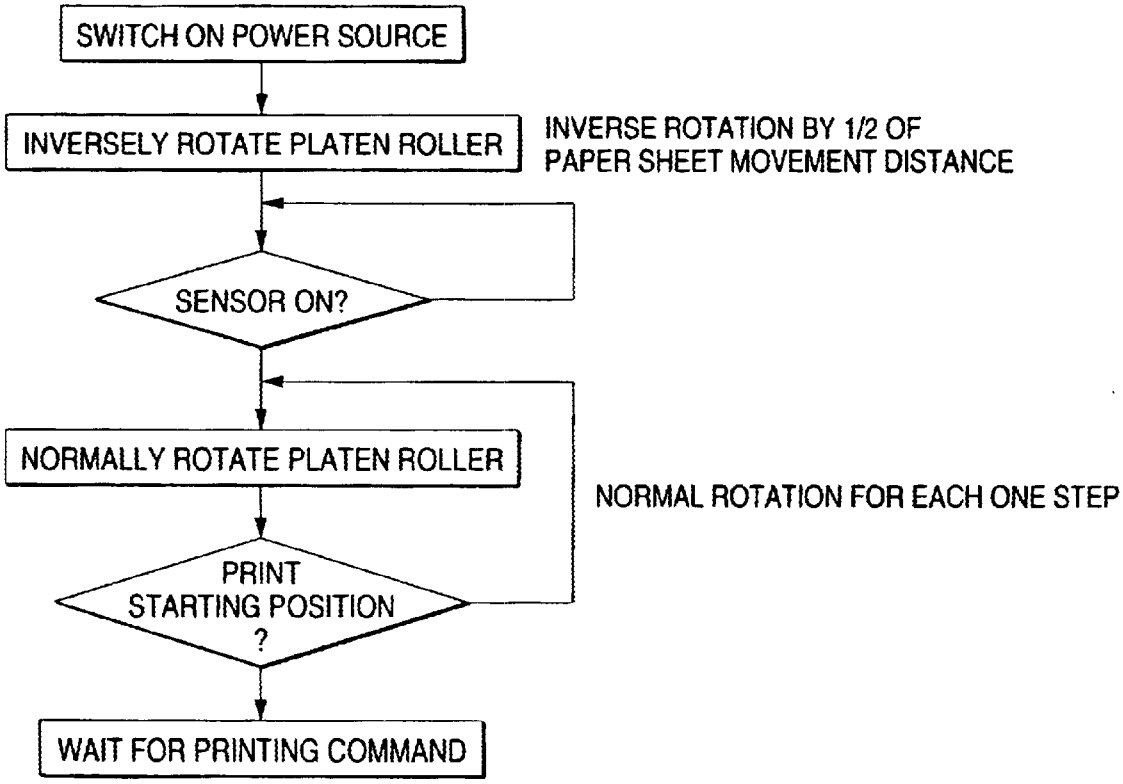
FIG. 5 is a flow chart showing the control operation procedure in the case of printing a remaining paper sheet.

Description has been given for the example of removing a remaining paper sheet, but it is also possible to print the remaining paper sheet. FIG. 5 shows the control operation procedure from the inverse rotation control of the platen roller 1 of FIG. 3(B). That is, when the platen roller 1 is rotated inversely by the length B (corresponding to the half of the paper sheet movement distance) so that the rear end of the paper sheet 5 is detected by the paper sensor 10 as shown in FIG. 3(B) after switching on the power source for normally rotating the platen roller 1, the platen roller 1 is rotated normally. Thereafter, with the tip part of the paper sheet 5 fed to a predetermined print starting position previously set, the normal rotation of the platen roller 1 is stopped for waiting for the printing command.

According to the above control, even when a paper sheet remains in the conveyance path 6, a printing operation can be executed on the paper sheet without removing.

Although the control procedure when the power source is switched on has been described so far, also when the discharge switch 11 provided in the operation section of a printer housing is pressed, the remaining paper sheet is removed or printed in the same process as described above. Moreover, the same is applied to the case when the reset switch 13 is pressed. However, in the case the reset switch 13 is pressed, after discharging the remaining paper sheet to the manual paper supply opening 12, the device as a whole is reset. Furthermore, by pressing the discharge switch 11 or the reset switch 13 again, the platen roller 1 can be rotated inversely again. Moreover, a configuration of returning a printed paper sheet to the manual paper supply opening 12 has been described in the embodiment, the present invention can be applied also to a device with a configuration of discharging a printed paper sheet to a discharge opening provided independently from the paper supply opening. In a device having a paper supply opening and a paper discharge opening separately, a roller is controlled so as to be rotated by a predetermined length in the paper discharge opening direction at a predetermined time before supplying a paper sheet, such as when the power source is switched on. Accordingly, for the same reason as in the above description, a remaining paper sheet can be discharged to the outside certainly without the need of providing a sensor specially for detecting the remaining paper sheet.

As described above, according to the invention, a paper sheet remaining in the device can be discharged to the outside certainly without the need of a sensor for detecting the remaining paper sheet.

Moreover, in a configuration wherein the paper supply opening and the paper discharge opening are the same, a paper sheet remaining in the device can be detected by a paper sensor disposed at the paper supply opening.

Furthermore, since a predetermined length for inversely rotating the paper feed roller is set to be the distance between the paper sensor and the paper catching position of the roller, the paper sensor can be switched on certainly by the remaining paper sheet regardless of the state the paper sheet is remaining in the device.

Moreover, since the roller is rotated by a predetermined length when the power source is switched on, a remaining paper sheet can be removed certainly before setting a new paper sheet for starting printing, and thus jamming can be prevented in the printing operation thereafter.

Furthermore, since the above-described operation can be executed by the discharge switch, a remaining paper sheet can be discharged anytime optionally.

Moreover, by normally rotating the roller again when the paper sensor provided at the paper supply opening is switched on after inversely rotating the roller at a predetermined time, a paper sheet remaining in the device can be used as it is when the printing operation is resumed.

What is claimed is:

1. A paper sheet feeder for printing paper sheets comprising:

a roller for feeding a paper sheet supplied from a manual paper supply opening to a printing section and discharging the paper sheet after printing to a paper discharge opening, said roller having a cylindrical surface and wherein said paper sheet directly contacts the cylindrical surface at a predetermined point on said cylindrical surface; and means for rotating the roller at a predetermined time before paper sheet supply by a predetermined length toward the paper sheet discharge opening, further comprising means for providing reverse rotation of said roller upon start-up actuation of the feeder, said reverse rotation being regardless of the presence of a paper sheet in the feeder, said feeder having a paper sheet conveyance path wherein the conveyance path has a length double that of the length of the paper sheet, and wherein the roller is disposed in the middle of the conveyance path.

2. The paper sheet feeder of claim 1, sensor means for detecting a paper sheet in the feeder.

3. The paper sheet feeder of claim 2, said means providing said reverse rotation of the roller regardless of whether the sensor means detects a paper sheet.

4. The paper sheet feeder of claim 3, said sensor means being disposed at the paper supply opening.

5. The paper sheet feeder of claim 4, said feeder comprising a single sensor means.

* * * * *